US005374172A

United States Patent [19]

Edwards

[11] Patent Number: 5,374,172

[45] Date of Patent: Dec. 20, 1994

[54] ROTARY UNIVANE GAS COMPRESSOR

[76] Inventor: Thomas C. Edwards, 1426 Gleneagles Way, Rockledge, Fla. 32955

[21] Appl. No.: 131,259

[22] Filed: Oct. 1, 1993

[51] Int. Cl.[5] ..... F01C 1/344; F01C 18/344

[52] U.S. Cl. ..... 418/151; 418/265

[58] Field of Search ..... 418/151, 241, 257, 265

[56] References Cited

U.S. PATENT DOCUMENTS

| | | | |
|---|---|---|---|
| 1,635,523 | 7/1927 | Wilson | 418/151 |
| 2,015,501 | 9/1935 | Sorge | 418/151 |
| 2,590,727 | 3/1952 | Scognamillo | 418/265 |
| 4,898,526 | 2/1990 | Sakamaki et al. | 418/257 |

FOREIGN PATENT DOCUMENTS

| | | | |
|---|---|---|---|
| 514354 | 11/1920 | France | 418/265 |

*Primary Examiner*—John J. Vrablik

*Attorney, Agent, or Firm*—Roger W. Jensen

[57] ABSTRACT

A single rotating vane gas compressor comprising a casing having a longitudinal bore with end plate means. A generally right cylindrical rotor is eccentrically for rotation within the bore; it carrier within a radial slot thereof a vane freely slidable in a radial direction. The radial travel of the vane is controlled by the vane being pivotally mounted on an axle the two ends of which are held by the inner race of a bearing means positioned in the end plate means.

8 Claims, 4 Drawing Sheets

ROTARY UNIVANE GAS COMPRESSOR

FIELD OF THE INVENTION

This invention is related to an emerging specialized field of guided rotary sliding vane machinery in which the radial motion of the vanes with respect to a stator bore is controlled to obtain noncontact sealing between vane tips and the stator bore as a result of the cooperation of the radius of the vane extension and the stator bore. Reference is made to my two prior patents in this field, namely U.S. Pat. No. 5,087,183 issued Feb. 11, 1992, and the continuation in part thereof, namely U.S. Pat. No. 5,160,252 issued Nov. 3, 1992; some of the technical information and some of the technical principles disclosed in my aforesaid patents are relevant to an understanding of the present invention and, accordingly, Applicant's aforesaid patents are incorporated herein for reference.

BACKGROUND OF THE INVENTION

Conventional and elementary sliding rotary vane machines are distinguished from virtually all other fluid displacement machines in their remarkable simplicity. However, prior to Applicant's aforesaid patents, the prior art machines known to Applicant were characterized by exhibiting relatively poor operating efficiency. As is well known, the poor energy efficiency is caused by mechanical and gas dynamic machine friction.

Application of the principles and unique concepts disclosed and claimed in my aforesaid prior patents has proven very successful, exceeding expectations. However, it may be difficult to apply such concepts to very small diameter compressor apparatus. The present invention is a unique concept which, without limitation, is especially applicable to the small size machines.

SUMMARY OF THE INVENTION

The present invention is characterized by the use of only a single rotating vane. The single vane machine is special because, unlike multivane embodiments such as shown in my aforesaid prior patents, conventional dual race roller bearings can be used to control the radial noncontact location of the single vane. In the multiple-vane embodiments disclosed in my prior patents, the radial and tangential velocities of the vane are constantly varying with respect to one another and, thus, require the use of special segmented bearings that allow each vane to vary in speed independent of the other. My unique concept is characterized in part by providing additional means so that the rotating rotor and vane is dynamically balanced. Compressors utilizing my unique concept are extraordinarily simple as compared to prior art apparatus. Further, they are characterized by having very low mechanical friction and excellent gas sealing and, hence, are very energy efficient.

BRIEF DESCRIPTION OF FIGURES

FIG. 5*a* shows a cross-section of a bearing comprising an inner race and an outer race; FIG. 5*b* shows a special insert for assembly with the bearing shown in FIG. 5*a;* and FIG. 5*c* shows the aforesaid bearing assembly or sub assembly.

DETAILED DESCRIPTION

Figure 1:
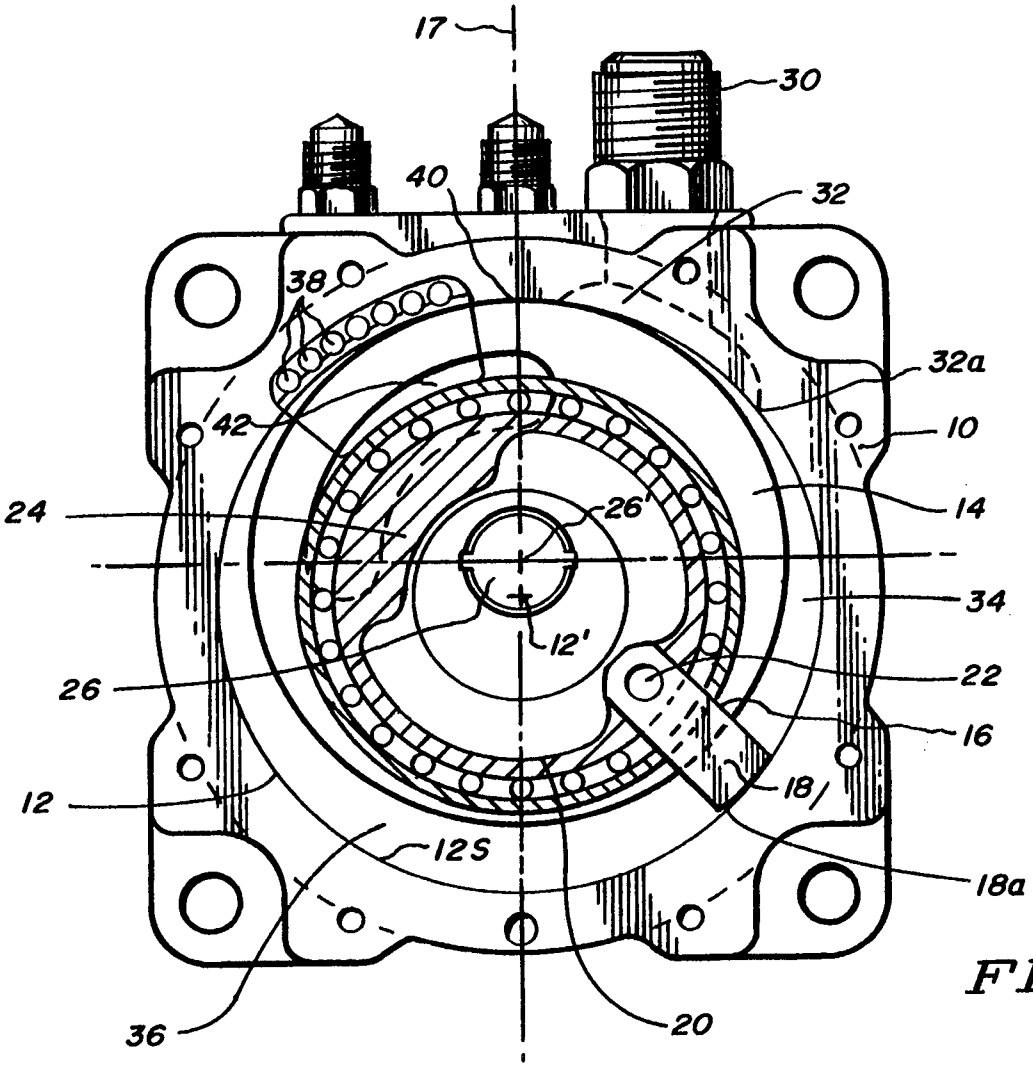
FIG. 1 presents an elevational view of my invention, with one end plate removed so as to reveal the rotor and its single sliding vane, the stator housing and the bore therein.

The drawings disclose a single vane fluid displacement apparatus comprising a stator housing 10 having a right cylindrical bore 12 therethrough, bore 12 having a preselected diameter and a preselected longitudinal axis 12'. Bore 12 also has a preselected longitudinal length 12L and a generally continuous inner surface 12S curved concentrically around said longitudinal axis 12'.

Means are provided for closing off the ends of the bore 12. The preferred embodiment depicted in the drawings shows first and second stator end plate means 13 and 15 at each end of said circular bore to define and enclose space within the housing.

A rotor shaft 26 carrying a rotor 14 is eccentrically positioned in bore 12 and is supported by bearing means 28 and 28A in end plate means 13 and 15 respectively for rotation about a rotor shaft access 26', which is parallel to but spaced from said longitudinal axis 12' a preselected distance. The spacing or distance between the longitudinal axis 12' and the rotor axis 26' is clearly depicted in FIG. 1 as is the eccentricity of the rotor 14 with respect to the inner surface 12S of the stator housing 10. Thus, as depicted in FIG. 1, rotor 14 has a diameter selected so that when it is mounted on the shaft 26, the top of the rotor 14 is in near contact with the inner surface 12S of the bore; this is designated by the reference numeral 40. Another way of defining the foregoing is to visualize a plane 17 which includes both axes 12' and 26' (said axes being parallel to one another); the thus defined plane 17 is perpendicular to the plane of the paper including FIG. 1 and, as indicated, includes the axes 12' and 26'. Thus, the plane 17 would pass through the point on the periphery of the rotor 14 as designated by the reference numeral 40 in FIG. 1.

Figures 5A, 5B, 5C:
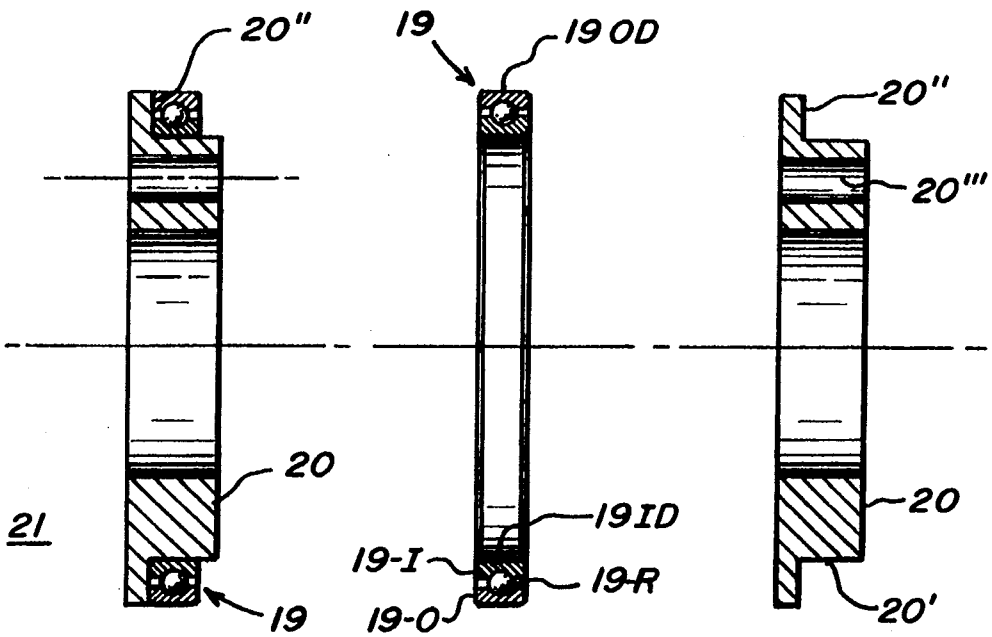

Referring to FIGS. 5*a*, 5*b* and 5*c*, the anti-friction radial vane guide assembly or subassembly is identified by reference numeral 21; it comprises a conventional anti-friction bearing 19 having an outer race 19-O, an inner race 19-I, and a plurality of elements 19-R therebetween. The anti-friction elements 19-R may be balls (as shown) or rollers or other arrangements known to those skilled in the art. The beating 19 has an outer diameter 19-OD and an inner diameter 19-ID. A special insert 20 is provided to be nested within the bearing 19. More specifically, the insert 20 shown in FIG. 5*b* comprises a main body portion having an outer diameter 20' preselected so that element 20 can fit within the inner race of bearing 19, as is shown clearly in FIG. 5*c*. Member 20 further has a radially extending flange 20'' extending beyond the circumferential surface 20' to define a shoulder against which the beating 19 is abutted, as is shown in FIG. 5*c*.

Figure 2:
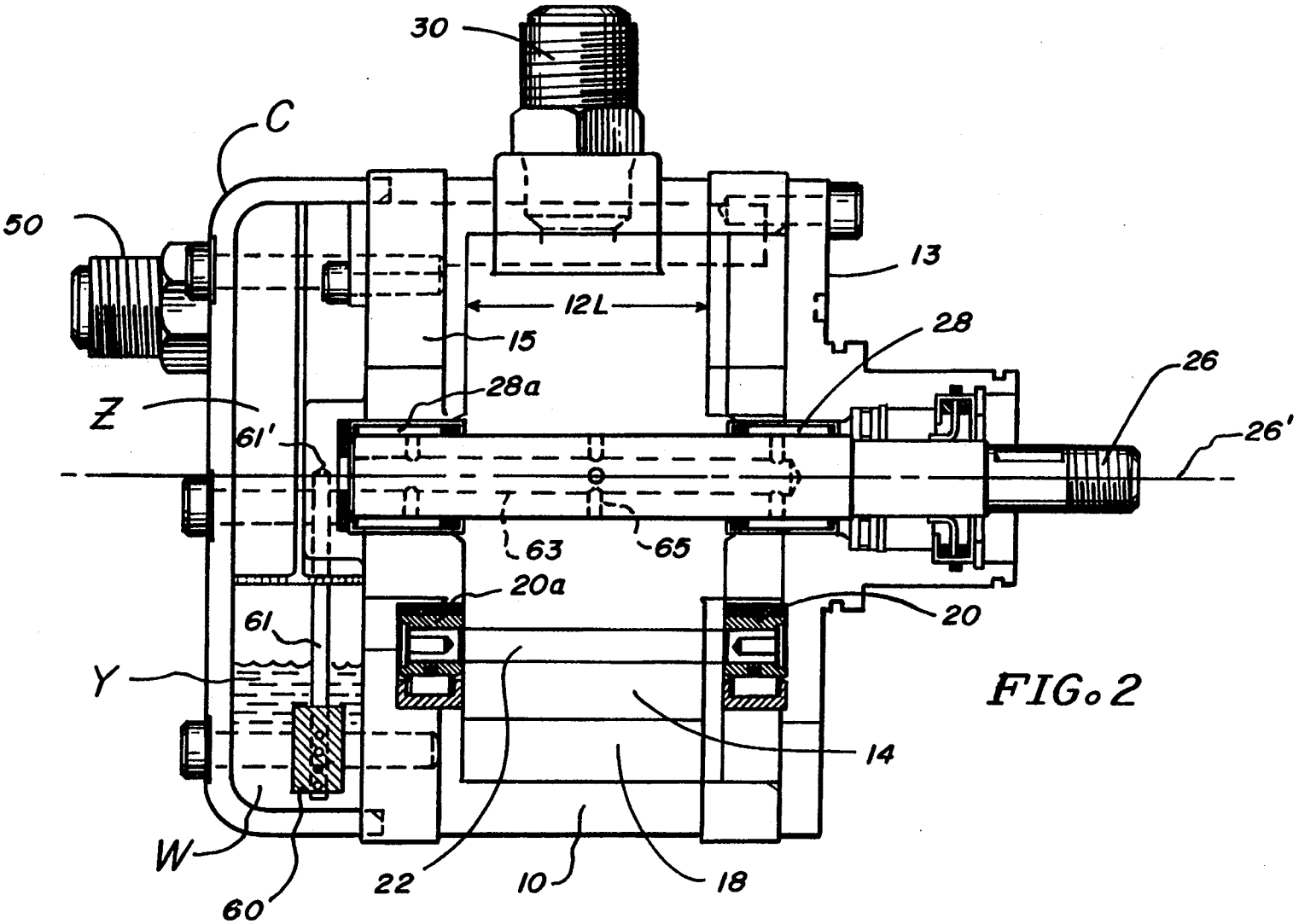
FIG. 2 is a side elevation of the apparatus shown in FIG. 1 with certain items therein shown in cross-section.

Special insert 20 further includes a bore 20''' passing longitudinally therethrough, as shown in FIG. 5, for receiving an axle 22, shown in FIGS. 1 and 2.

Figure 4:
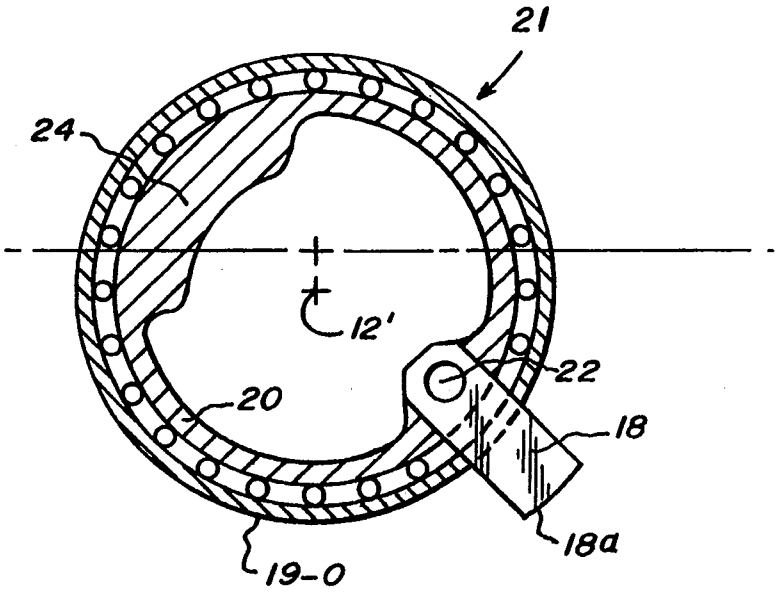
FIG. 4 shows one of a pair of anti-friction radial vane guide assemblies together with a vane.

FIG. 4 shows the vane guide assembly 21, together with an attached vane 18 in cross-section, the vane 18 being rotatably mounted on the axle 22. Alternatively, the axle 22 may be fixed with respect to the vane 18 while being rotatably supported in bore 20'''. Referring to FIG. 2, it is seen that the axle 22 is supported by member 20 positioned in end plate 13 concentric with the longitudinal axis 12', and at the other end in corresponding member 20a in end plate 15.

Referring again to FIG. 4, it is seen that the member 20 is nonsymetrical about the longitudinal axis 12'; more specifically, a counterbalance portion or weight 24 is provided diametrically opposite bore 20''' (i.e., the point for connection with the axle 22).

Figure 3:
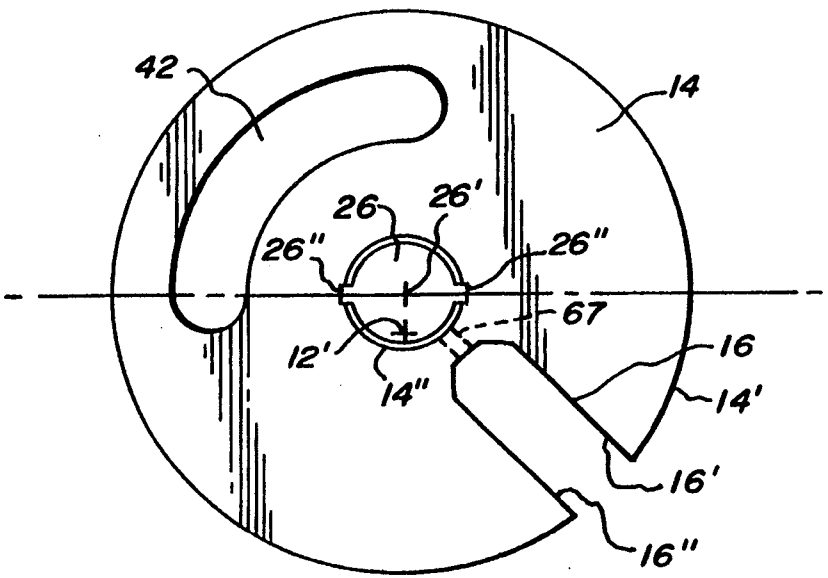
FIG. 3 shows an end view of the rotor.

The end view of the rotor 14 is shown in FIG. 3. The rotor shaft 26 fits within the appropriate central bore 14'' of the rotor, and suitable means such as keys 26''' are provided so that the rotor rotates with the shaft 26 which, it will be well understood, is adapted to be rotated by external means not shown.

Also depicted in FIG. 3 is a slot 16 in rotor 14 which extends radially from axis 26' having a preselected slot width (i.e., the straight line distance between the two sides of the slot 16' and 16'') and terminating at the outer periphery of the rotor 14'. Slot 16 extends the entire longitudinal length of the rotor 14 (i.e., from one axial end to the other).

Rotor 14 has a counterbalance hole or aperture 42 extending, preferably, the entire longitudinal extent or length of the rotor from one axial end to the other. As depicted, aperture 42 has an arcuate shape, the effective mass moment center of which is exactly diametrically opposite to the effective or central axis of the slot 16. As will be understood by those skilled in the art, the aperture 42 assists in the function of providing a dynamic balance to the rotating assembly comprising the rotor, the vane 18, and the two vane guide assemblies and the axle 22.

Vane 18 is shown in FIGS. 1 and 4 to have a generally rectangular cross-section, and in FIG. 2 to have a longitudinal length essentially the same as the longitudinal length of the bore. The vane, as indicated, is pivotally mounted on the axle 22 carded by the members 20 and 20a. The tip radius of the vane 18 is identified by reference numeral 18a in FIGS. 1 and 4. The arcuate width of the vane 18 is preselected so that the vane may freely slide back and forth within the slot 16 of the rotor.

Further, the tip radius is selected with regard to the preselected diameter of the bore of the stator and the distance of the axis of the axle 22 from the longitudinal axis 12'. I have found that a very successful clearance to have between the face or tip 18a of the vane with respect to the inner surface 12S of the bore is in the range of 0.002 inches to 0.004 inches. This clearance will yield excellent operating results while still permitting relatively low cost for manufacture of the unit.

A gas inlet means 30 mounted on the casing or housing 10 (to the right of plane 17, as shown in FIG. 1) is connected to a gas suction manifold 32 recessed into the housing from the bore 12. When rotor 14 rotates (clockwise as shown in FIG. 1) about the rotor axis 26', suction gas enters the apparatus at inlet port 30. This gas then flows into the suction manifold region 32 and continues to flow past the trailing edge 32a thereof into the expanding suction volume cavity 34 behind vane 18.

The gas volume (represented by reference numeral 36) in front of the rotating vane 18 can be seen to be decreasing in size as the rotor vane assembly continues to rotate. When the pressure within the compressing volume 36 slightly exceeds the pressure into which the compressed gas is to be discharged, then the gas will flow out from the compressor through an outlet port manifold region 38 which, as shown in FIG. 1, is to the left of plane 17 and from the outlet port manifold region 38 to a sump Z formed within a cup-like endbell C having an outlet port 50, shown in FIG. 2. As the existing gas flows into the relatively large volume sump space or region Z, the gas rapidly decelerates. Liquid lubricant that is entrained in the gas flow thus tends to agglomerate and falls, in response to gravitational forces, to the bottom W of sump Z. The agglomerated lubricant is identified by reference Y and is, of course, under high pressure existing in the sump Z. Immersed in the lubricant Y is an inlet means 60 of liquid conduit means 61 which is connected at or near the upper end 61' thereof to a lubrication bore 63 centrally positioned and longitudinally extending through part of shaft 26 as is shown in FIG. 2. A radially extending bore 65 connects bore 63 to the outer periphery of shaft 26 and thence to a suitable conduit 67 (see FIG. 3) in the rotor 14 which permits a flow of lubricant to the slot 16 for the function of lubricating the sliding of the vane 18 radially within the slot. Also, the lubricant is provided to other portions of the compressor (e.g., the rotor shaft bearings 28 and 28a.

Gas leakage flow from the high or elevated pressure volume section 36 to the suction region 34 is minimized across the rotor/stator seal region 40 by the close tangential proximity of the rotor outside diameter and the preselected stator bore in that region.

Figure 6:
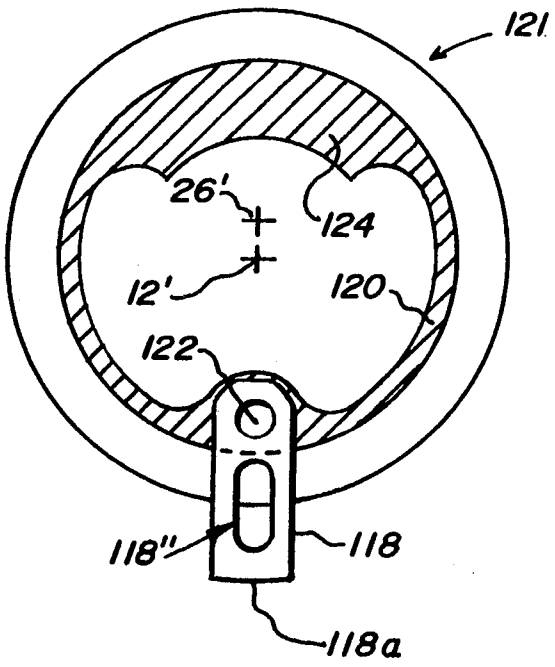
FIG. 6 shows an end view of a modified vane guide assembly, having attached thereto a vane of modified construction.

FIG. 6 shows a modified vane guide assembly 121 which differs from assembly 21 in two respects either or both of which may be selected in the application of my invention. More specifically, the member 120 functions as the inner race of the anti-friction bearing. The other change is that a longitudinally extending void or bore 118'' is provided in vane 118' to facilitate dynamic balancing of the assembly.

The present invention can be embodied in ways other than those specifically described here which, on the one hand, have been presented as the preferred embodiment but also by way of non-limitative example. Variations and modifications can be made without departing from the spirit and scope of the invention herein described. The invention should be limited only by the appropriate scope of the following appended claims.

I claim:

1. A single vane displacement apparatus comprising:

(a) a stator housing having a right cylindrical bore therethrough, said bore having a preselected diameter, a preselected longitudinal axis and length, and a generally continuous inner surface curved concentrically around said longitudinal axis;

(b) first and second stator end plate means attached to said housing at each end of said circular bore to define an enclosed space within said housing;

(c) a rotor shaft eccentrically positioned in said bore and supported by bearing means in said end plate means for rotation about a rotor shaft axis parallel to but spaced from said longitudinal axis a preselected distance;

(d) a right cylindrically shaped rotor in said bore mounted on and connected to said rotor shaft so as to rotate integrally therewith about said rotor shaft axis, said rotor having (i) two axial ends, (ii) a longitudinal length preselected to be substantially the same as the longitudinal extent of said bore, and (iii)

a radially extending slot having a preselected slot width and terminating at the outer periphery of said rotor, said slot also extending longitudinally between said two axial ends;

(e) first and second anti-friction radial vane guide assemblies, each assembly comprising an outer race having a pre-selected diameter, an inner race concentrically and rotatably mounted within said outer race, said first and second assemblies being respectively mounted in said first and second end plate means with the rotational axes thereof being concentric with said longitudinal axis;

(f) an axle connected to said inner races of said first and second assemblies;

(g) a vane having a generally rectangular shape with a longitudinal length preselected to be essentially the same as said longitudinal length of said rotor, a thickness preselected to permit said vane to slidably fit within said rotor slot, and an outer tip surface, said vane being rotatably mounted on said axle and being positioned within said rotor slot with said outer surface thereof being adjacent to said inner surface of said bore in a non-contacting but sealing relationship;

(h) gas inlet means and gas outlet means mounted on said housing;

(i) a suction manifold recessed into said housing from said bore and connected to said gas inlet means;

(j) an outlet manifold recessed into said housing from said bore and connected to said gas outlet means, said suction and outlet manifolds being respectively positioned on opposite sides of a plane defined by said rotor and longitudinal axes; and (k) means for rotating said rotor.

2. Apparatus of claim 1 further characterized by said inner races of said first and second radial vane guide assemblies including dynamic balancing means.

3. Apparatus of claim 1 further characterized by anti-friction elements being positioned between inner and outer races.

4. Apparatus of claim 1 further characterized by said outer tip surface of said vane being curved concentrically with respect to said longitudinal axis.

5. Apparatus of claim 2 further characterized by said dynamic balancing means comprising additional mass on said inner races, the center of said additional mass being diametrically opposite said axle.

6. Apparatus of claim 1 further characterized by including means for dynamic balancing of said assembled apparatus.

7. Apparatus of claim 6 further characterized by said dynamic balancing means including additional mass on said inner races centered diametrically opposite said axle.

8. Apparatus of claim 7 further characterized by said vane having a longitudinally extending void therein to reduce the mass thereof without sacrifice of pumping function.

* * * * *